United States Patent [19]

Yamamoto et al.

[11] Patent Number: 4,929,366

[45] Date of Patent: May 29, 1990

[54] FINISH COMPOSITIONS FOR SYNTHETIC YARNS

[75] Inventors: Hisao Yamamoto; Atsushi Nakamura, both of Aichi, Japan

[73] Assignee: Takemoto Yushi Kabushiki Kaisha, Aichi, Japan

[21] Appl. No.: 287,426

[22] Filed: Dec. 20, 1988

[30] Foreign Application Priority Data

Jan. 9, 1988 [JP] Japan ..... 63-2752

[51] Int. Cl.[5] ..... D06M 1/00

[52] U.S. Cl. ..... 252/8.6; 252/8.7

[58] Field of Search ..... 252/8.6, 8.7

[56] References Cited

FOREIGN PATENT DOCUMENTS

| | | |
|---|---|---|
| 44-29552 | 12/1969 | Japan . |
| 47-29474 | 5/1972 | Japan . |
| 50-136499 | 10/1975 | Japan . |
| 52-103590 | 8/1977 | Japan . |
| 57-82573 | 11/1986 | Japan . |
| 1492052 | 11/1977 | United Kingdom . |

*Primary Examiner*—Paul Lieberman
*Assistant Examiner*—John F. McNally
*Attorney, Agent, or Firm*—Flehr, Hohbach, Test, Albritton & Herbert

[57] ABSTRACT

A finish composition for synthetic yarns contains 10–80 wt % of a lubricant including a compound shown by Formula (1) given below and 10–60 wt % of a surfactant:

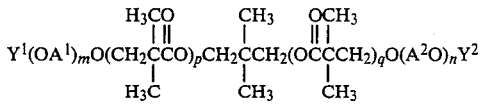

(1)

where $Y^1$ and $Y^2$ are monocarboxylic acid residues shown by Formula (2) or Formula (3) given below, at least one of $Y^1$ and $Y^2$ being monocarboxylic acid residue shown by Formula (2), $A^1$ and $A^2$ are alkylene groups with 2–4 carbon atoms, m and n are same or different, each being 0 or an integer in the range of 1–10, p and q are equal or different, each being 0 or an integer in the range of 1–4 such that (p+q) is an integer in the range of 1–4:

$$R^1S(CH_2)rCO— \quad (2)$$

where $R^1$ is alkyl group or alkenyl groups with 6–22 carbon atoms and r is an integer in the range of 1–3, and $$R^2CO— \quad (3)$$

where $R^2$ is alkyl or alkenyl group with 7–25 carbon atoms.

15 Claims, No Drawings

FINISH COMPOSITIONS FOR SYNTHETIC YARNS

BACKGROUND OF THE INVENTION

This invention relates to finish compositions for synthetic yarns.

Recently, conditions which are required for the production and fabrication of synthetic yarns are becoming increasingly severe and higher processabilities are coming to be required of the finishes which are used in their production and fabrication. In the case of synthetic filaments used for textured yarns, sewing threads, tire cord yarns and also as materials in various industries, particularly severer production and fabrication conditions are being adopted. For textured yarns of polyester, nylon and acryl, for example, heater temperature is set to 200°-240° C. for yarns traveling at a fast rate of 400-1200 m/min and a continuous operation extending over several weeks is required under such conditions. For tire cord yarns, heater temperature is set to 200°-250° C. for yarns which are drawn with a high tensile force and the absence of fluffs and filament breakage is required under such conditions. Similar requirements are also imposed on filaments for sewing threads and those used as various industrial materials.

If there is fuming from a finish composition used in the production or fabrication process of synthetic yarns, on the other hand, the work environment is adversely affected and the apparatus as well as the yarns become contaminated by the generated mist of oil. If the finish composition becomes colored when it is heated, this has the effect of degrading the yarn quality. If tar is generated from these finish compositions, heat efficiency becomes low and fluffs and filament breakages occur because the running of the yarn is obstructed. If the lubricity of the finish composition is not sufficient, furthermore, abrasion of the components contacting the running yarns is accelerated and the damage to the yarns also becomes more serious. If the finish composition is poor in boundary friction lubricity, fluffs and filament breakages occur frequency under high tensile conditions.

Although many compounds have been considered as a finish composition for synthetic yarns, none of them simultaneously possesses the heat resistance and dynamic and boundary friction lubricity satisfying the recent requirements as described above. For example, aliphatic esters of polyhydric alcohol (such as trimethylol propane) having a neo structure within the molecule (as disclosed in Japanese Patent Publication Tokko No. 44-29552) have higher dynamic friction and poor boundary and hence are not sufficient in dynamic and boundary friction lubricity under high-speed and high-tensile conditions. Fatty esters of ethoxylated bisphenol-A (as disclosed in Japanese Patent Publication Tokko No. 47-29474) are poor in dynamic friction lubricity and have the problems of fluffs and yarn breakages. Esters derived from thiodicarboxylic acid (as disclosed in Japanese Patent Publication Tokkai No. 52-103590) are poor in boundary and have the problem of inferior boundary friction lubricity. Compounds derived from thiodicarboxylic acid and neopentyl glycol (as disclosed in Japanese Patent Publication Tokkai No. 52-103593) have the problem of being poor in both dynamic and boundary friction lubricity. Esters of an alkyl or alkenyl thiocarboxylic acid and a polyhydric alcohol such as neopentyl glycol (as disclosed in Japanese Patent Publication Tokkai No. 57-82573) have superior heat resistance but since they have a poor boundary, they have the problems of fluffs and yarn breakages under high tensile conditions and of being poor in boundary friction lubricity. Diesters of esterdiol obtainable from one mole of a glycol having quaternary carbon such as neopentyl glycol and one mole of a hydroxy carboxylic acid similarly having quaternary carbon such as hydroxypivalic acid and aliphatic monocarboxylic acid (as disclosed in Japanese Patent publication Tokkai No. 50-136499 and British Patent No. 1492052) are superior in dynamic friction lubricity under high-speed running conditions and boundary friction lubricity under high-tensile conditions but have the problems of coloring and tar deposits when heated and also of being poor in heat resistance.

SUMMARY OF THE INVENTION

It is therefore an object of the present invention in view of the above to provide finish compositions for synthetic yarns with which the problems of prior art compositions described above can be eliminated.

It is more specifically an object of the present invention to provide finish compositions which can respond to the stringent requirements under the severe production and fabrication conditions of synthetic yarns, being heat resistant from the points of view of fuming, coloring and tar deposition and having superior dynamic and boundary friction lubricity characteristics.

The present invention has been accomplished by the present inventors as a result of their diligent studies in view of the aforementioned stringent requirements on finish compositions for synthetic yarns and is based on their discovery that these requirements are satisfied by diesters of a special kind obtainable by esterification of at least one hydroxyl group of diols from neopentyl glycol monopivalate, neopentyl glycol polypivalate or their alkylene oxide adduct by using aliphatic thioether carboxylic acid.

DETAILED DESCRIPTION OF THE INVENTION

Finish compositions for synthetic yarns according to this invention are characterized as comprising 10-80 wt % of a lubricant including a compound shown by Formula (1) given below and 10-60 wt % of a surfactant:

$$Y^1(OA^1)_mO(CH_2\overset{H_3CO}{\overset{|}{C}}\overset{\|}{C}O)_pCH_2\overset{CH_3}{\overset{|}{C}}CH_2(O\overset{OCH_3}{\overset{\|}{C}}\overset{|}{C}CH_2)_qO(A^2O)_nY^2 \quad (1)$$
$$\qquad\qquad\qquad $R^2CO-$ (3)

where $R^2$ is alkyl or alkenyl group with 7–25 carbon atoms.

Examples of monocarboxylic acid of which Formula (2) shows a residue include γ-octyl thiobutanoic acid, β-lauryl thiopropanoic acid, β-myristyl thiopropanoic acid, β-isocetyl thioacetic acid, β-oleyl thiopropanoic acid and α-octyl thioacetic acid. Examples of monocarboxylic acid of which Formula (3) shows a residue include caprylic acid, capric acid, lauric acid, palmitic acid, isostearic acid, arachic acid, oleic acid, erucic acid, selacholeic acid, cerotic acid and linolic acid.

Regarding the choice of monocarboxylic acid residues for $Y^1$ and $Y^2$ in Formula (1), it is preferable that $Y^1$ and $Y^2$ be both a monocarboxylic acid residue shown by Formula (2) if heat resistance is important but it is preferable that either one of $Y^1$ and $Y^2$ be a monocarboxylic acid residue shown by Formula (3) if lubricity is additionally to be considered important.

$A^1$ and $A^2$ in Formula (1) are derivable from ethylene oxide, propylene oxide and butylene oxide and introduced by addition polymerization of these alkylene oxides with or without mixing. Both block addition and random addition are acceptable in the case of mixing but those obtained by addition polymerization only with ethylene oxide or by mixing propylene oxide thereto are preferable. In this case, m and n may each be 0 or an integer in the range of 1–10, depending on the purpose for which the finish composition is used. If either m or n exceeds 10, this adversely affects the dynamic and boundary friction lubricity of the obtained finish composition. In Formula (1), p and q are each 0 or an integer in the range of 1–4 such that (p+q) is an integer in the range of 1–4. If (p+q) exceeds 5, this adversely affects the dynamic friction lubricity. It is preferable that (p+q) be in the range of 1–3, and more particulary either 2 or 3, from the points of view of heat resistance and dynamic and boundary friction lubricity, although this depends on the kind of monocarboxylic acid used for esterification. Even if (p+q) is 1, a lubricant with satisfactory heat resistance and dynamic and boundary friction lubricity can be obtained by selecting (m+n), $Y^1$ and $Y^2$ of Formula (1) appropriately according to the desired result, for example, by selecting (m+n) to be 2–20 and both $Y^1$ and $Y^2$ to be a monocarboxylic acid residue shown by Formula (2).

Compounds shown by Formula (1) can be produced by many known methods. For example, ester diol or polyester diol is obtained first by an esterification reaction through low-pressure dehydration at 110°–180° C. of one mole of neopentyl glycol and 1–4 moles of hydoxy pivalic acid in the presence of paratoluene sulfonic acid and alkylene oxide is added to it as desired in the presence of an alkaline catalyst at 100°–130° C. A desired compound is then obtained by low-pressure dehydration of this reaction product and an aforementioned monocarboxylic acid at 110°–180° C. in the presence of paratoluene sulfonic acid for an esterification reaction.

Finish compositions according to the present invention are characterized as containing not only 10–80 wt % of a compound shown by Formula (1) but necessarily also 10–60 wt % of a surfactant such as a nonionic surfactant or an anionic surfactant for emulsification and antistatic purposes.

Examples of nonionic surfactant, which do not adversely affect the heat resistance characteristic of the finish composition and are preferable from the point of view of emulsification, include aliphatic esters of polyalkoxylated polyols such as glycerine, sorbitol and sorbitan, polyalkoxylated castor oil, alkoxylated hydrogenated castor oil and polyoxy alkylene adducts of alkylamine. They may be used concurrently with an already known nonionic surfactant such as polyoxy alkylene alkylether and polyoxy alkylene alkylphenylether. An anionic surfactant may be selected from known sulfonates and phosphates but alkyl phosphates, polyoxy alkylene alkylether phosphates, alkyl sulfonates and dialkyl sulfosuccinates are preferable from the points of view of antistatic and emulsion characteristics as well as compatibility with the lubricant compound. The combination of such surfactants and their mixing ratios are to be appropriately determined, depending on the kinds of lubricant components, the ratio of their use, the purpose of use as a finish composition and the desired effects.

The finish composition of the present invention may contain a compound shown by Formula (1) at any concentation as long as its effects are substantially manifested. The concentration should be 10–80 wt % and more preferably in the range of 20–60 wt %. In addition, a surfactant of a known kind may also be contained within the limit that the effects of the compound shown by Formula (1) are not adversely affected. In particular, compositions containing 50–95 wt % of a compound shown by Formula (1) and 5–50 wt % of a triglyceride of aliphatic acid have superior characteristics regarding boundary friction lubricity and heat resistance. Similarly, compositions containing 10–50 wt % of a compound shown by Formula (1) and 50–90 wt % of a polyether compound are superior in heat resistance and preventing tar deposition. In addition, antioxidants, ultraviolet absorbants, extreme pressure additives and antiseptics may be contained.

The finish compositions of the present invention may be applied to synthetic yarns during the spinning process, the drawing process and each of the processes after the drawing by spraying, dipping, the kiss roll method or the metering application method either directly as they are or in the form of a solution in an organic solvent or an aqueous emulsion. In these cases, the rate of application should be 0.1–3 wt % with respect to synthetic yarns and more preferably 0.2–2 wt %.

In what follows, examples are presented to more clearly describe the present invention but it goes without saying that the invention is not intended to be limited by these examples.

EXAMPLE NOS. 1–8 AND COMPARISON EXAMPLES NOS. 1–5

Use was made of compounds (A–G) according to the present invention, prior art lubricant constituents (A'–E') and the surfactants described in Table 1 to prepare compositions shown in Table 2. Heat resistance and dynamic and boundary friction lubricity of these compositions were evaluated as follows. The results of evaluation are shown in Table 2.

To evaluate the fuming characteristics of the compositions, a 10-wt % hexane solution of each composition was prepared and 2 (effective equivalent) wt % thereof was attached by dipping to an aromatic polyamide cloth of 5 g which had preliminarily been washed and dried. After hexane was evaporated, the cloth was placed inside an oven at 240° C. for a heat processing for 2 minutes. The resulting fuming was measured (in units of counts) by a digital dust counter (Model P-5C produced by Shibata Kagaku Kikai Kogyo-sha). The results were evaluated as follows:

200 or less: A
201–500: B
501–1000: C
1001–3000: D
3001 or more: E

To evaluate the coloring upon heating, 25 g of each finish composition was placed inside a cylindrical container of stainless steel with 50 mm in diameter and 60 mm in depth and the color of the sample after a heat processing for 4 hours at 230°±2° C. inside a rotary hot air drier was compared with a specified standard color by the Gardner method. The difference in color before and after the aforementioned test was evaluated as follows:

2 or less: A
>2 and 4: B
>4 and 8: C
>8 and 12: D
Over 12: E

To evaluate the tar deposition characteristic, 1 g of each finish composition was placed on a plate of stainless steel with 70 mm in diameter and 8 mm in depth and after it was heated for 4 hours at 230°±2° C. inside a rotary hot air drier, the condition of tar deposition was visually inspected. The results of observation were evaluated as follows:

No tar deposits: A
Extremely few tar deposits: B
Some tar deposits: C
Tar deposits: D
Significant tar deposits: E Dynamic friction lubricity under a high-speed running condition was examined by washing and drying 70 denier/24 filament nylon yarns and a separately prepared 10-wt % hexane solution of each finish composition was applied thereto by the method of oiling by metering applicator. Hexane was thereafter evaporated at room temperature to obtain filaments with 1 (effective equivalent) wt % of the composition attached thereonto. These oiled filaments were run in contact with a friction pin made of titania ceramics under the conditions of 20° C. and 65% RH with the initial tension of 30 g and the filament velocity of 700 m/min and the coefficient of friction was measured by a $\mu$ meter (produced by Eiko Sokki-sha) and evaluated as follows:

0.33 or less: A
0.34–0.37: B
0.38–0.41: C
0.42–0.45: D
0.46 or over: E

Boundary friction lubricity under a high-tensile condition was tested by washing and drying 150 denier/36 filament polyester yarns and after a separately prepared 10-wt % hexane solution of each of the finish compositions was applied thereonto by a kiss roll method, hexane was evaporated at room temperature to obtain filaments with 0.7 (effective equivalent) wt % of each of the finish compositions attached thereonto. These oiled filaments were caused to run at the yarn velocity of 100 m/min in contact with a chrome rough surface pin with 40 mm in diameter and heated to 200° C., turning three times around a chrome smooth surface roller of 95 mm in diameter and heated also to 200° C. The initial tension $T^1$ was gradually increased to measure its value (in units of g) at the time of yarn breakage. The results were evaluated as follows:

270 or over: A
265–269: B
255–264: C
245–254: D
244 or less: E

EXAMPLE NOS. 9–12 AND COMPARISON EXAMPLES NOS. 6–9

Use was made of compounds (E, H and I) according to the present invention, prior art lubricant constituents (A', C', D', E' and F') and the surfactants described in Table 3 to prepare compositions shown in Table 4. Next, an 18-wt % emulsion of each of these compositions was prepared and attached by 0.6 (effective equivalent) wt % to defatted and dried 1500 denier/188 filament polyester yarns by the method of oiling by metered applicator. For the purpose of evaluating boundary friction lubricity under high temperature conditions, these oiled filaments were caused to turn three times around a chrome smooth surface roller of 95 mm in diameter and heated to 200° C. and to then run at the yarn velocity of 50 m/min and initial tension of 2 kg in contact with a chrome rough surface pin with 40 mm in diameter and heated to 240° C. The coefficient of friction was thereupon measured by a yarn friction meter (Model YF850 produced by Toray Engineering, Inc.). The results of these measurements were evaluated as follows and shown in Table 4:

0.38 or less: A
0.39–0.42: B
0.43–0.46: C
0.47–0.50: D
0.51 or over: E

EXAMPLES NOS. 13–14 AND COMPARISON EXAMPLES NOS. 10–11

Use was made of compounds (C and D) according to the present invention, prior art lubricant constituents (E', F', G' and H') and the surfactants described in Table 5 to prepare compositions shown in Table 6. Next, an 10-wt % emulsion of each of these compositions was prepared and applied by the kiss roll method to polyethylene terephthalate yarns spun by melting. They were wound up at the speed of 3500 m/min and 115 denier/36 filament partially oriented yarns (POY) were obtained each with 0.5 (effective equivalent) wt % of a composition attached thereonto.

Next, a false twisting apparatus having a frictional system with urethan disk (the length of first heater=2.0 m and the heater surface temperature=215° C.) was employed for simultaneous draw false twist texturizing of this POY under the conditions of draw ratio=1.518, take-up speed=500 m/min and intended number of twisting=3200 turns/m to obtain 75 denier/36 filament textured yarn. This operation was carried out continuously for 24 hours and the conditions of fuming above the false twist heater, tar deposits on the heater surface and generation of fluffs on the textured yarn were observed. Good results were obtained with all test examples but Comparison Example 9 had problems regarding tar deposits and fluffs and Comparison Example 10 had problems regarding fluffs and dynamic friction lubricity.

The results shown in the tables clearly indicate that the present invention provides superior overall characteristics with respect to heat resistance such as fuming, coloring of composition and tar deposits as well as dynamic and boundary friction lubricity.

TABLE 1

| Symbol | Compound |
|---|---|
| A | Compound shown by Formula (1) where $Y^1 = C_8H_{17}S(CH_2)_2CO—$; $Y^2 = C_9H_{19}CO—$; $A^1,A^2$ = equi-molar block addition of $C_2H_4—$ and $C_3H_6—$; m,n = 8; and (p + q) = 4 |
| B | Compound shown by Formula (1) where $Y^1 = C_{12}H_{25}S(CH_2)_2CO—$; $Y^2 = C_{21}H_{41}CO—$; m,n = 0; and (p + q) = 1 |
| C | Compound shown by Formula (1) where $Y^1 = C_{12}H_{25}S(CH_2)_2CO—$, $Y^2 = C_{14}H_{29}S(CH_2)_2CO—$; m,n = 0, and (p + q) = 1 |
| D | Compound shown by Formula (1) where $Y^1,Y^2 = C_{14}H_{29}S(CH_2)_2CO—$; $A^1,A^2 = C_3H_6—$; m,n = 2; and (p + q) = 2 |
| E | Compound shown by Formula (1) where $Y^1 = C_{12}H_{25}S(CH_2)_2CO—$; $Y^2 = C_{17}H_{33}CO—$; m,n = 0; and (p + q) = 2 |
| F | Compound shown by Formula (1) where $Y^1,Y^2 = C_{18}H_{37}S(CH_2)_2CO—$; $A^1,A^2 = C_2H_4—$; m,n = 2; and (p + q) = 1 |
| G | Compound shown by Formula (1) where $Y^1 = C_{18}H_{35}S(CH_2)_2CO—$; $Y^2 = C_{17}H_{33}CO—$; $A^1,A^2 = C_2H_4$; m,n = 2; and (p + q) = 1 |
| A' | rape seed oil |
| B' | neopentylglycol-dimyristate |
| C' | neopentylglycol-monohydroxypivalate-dioleate |
| D' | neopentylglycol-mono-β-laurylthiopropionate-monooleate |
| E' | neopentylglycol-di-β-laurylthiopropionate |
| | Surfactants |
| *1 | polyoxyethylene (5 mole) stearyl ether |
| *2 | polyoxyethylene (8 mole) condensate of castor oil |
| *3 | sodium dioctylsulfosuccinate |

TABLE 2

| | Example | | | | | | | | Comparison | | | | |
|---|---|---|---|---|---|---|---|---|---|---|---|---|---|
| | 1 | 2 | 3 | 4 | 5 | 6 | 7 | 8 | 1 | 2 | 3 | 4 | 5 |
| A | 70 | | | | | | | | | | | | |
| B | | 70 | | | | | | | | | | | |
| C | | | 70 | | | | | | | | | | |
| D | | | | 70 | | | | | | | | | |
| E | | | | | 70 | 70 | | | | | | | |
| F | | | | | | | 70 | | | | | | |
| G | | | | | | | | 70 | | | | | |
| A' | | | | | | | | | 70 | | | | |
| B' | | | | | | | | | | 70 | | | |
| C' | | | | | | | | | | | 70 | | |
| D' | | | | | | | | | | | | 70 | |
| E' | | | | | | | | | | | | | 70 |
| *1 | 15 | 15 | 15 | 15 | 15 | 25 | 15 | 15 | 15 | 15 | 15 | 15 | 15 |
| *2 | 15 | 13 | 15 | 15 | 15 | | 15 | 15 | 15 | 13 | 15 | 15 | 15 |
| *3 | | 2 | | | | 5 | | | | 2 | | | |
| Heat Resistance | | | | | | | | | | | | | |
| Fuming | A | B | B | A | A | B | A | A | B | C | B | C | B |
| Coloring | B | B | A | A | A | A | A | B | E | C | E | B | B |
| Tar | B | B | A | A | A | A | A | B | E | C | E | B | B |
| Friction Lubricity | | | | | | | | | | | | | |
| Dynamic | B | A | B | A | A | A | A | A | C | B | B | C | D |
| Boundary | A | B | B | A | A | B | B | A | A | D | A | D | C |

Note:
Numbers in units of wt %

TABLE 3

| Symbol | Compound |
|---|---|
| E | Same as in Table 1 |
| H | Compound shown by Formula 1 where $Y^1,Y^2 = C_{14}H_{29}S(CH_2)_2CO—$;$A^1A^2 = C_2H_4—$; m,n = 1; and (p + q) = 1 |
| I | Compound shown by Formula (1) where $Y^1,Y^2 = C_{14}H_{29}S(CH_2)_2CO—$; m,n = 0; and (p + q) = 3 |

TABLE 3-continued

| Symbol | Compound |
|---|---|
| A' | Same as in Table 1 |
| C' | Same as in Table 1 |
| D' | Same as in Table 1 |
| E' | Same as in Table 1 |
| F' | neopentylglycol-monooxypivalate-dilaurate |
| | Surfactants |
| *4 | POE (15 mole) condensate of castor oil |
| *5 | POE (20 mole) POP (10 mole) condensate of hydrogenated castor oil |
| *6 | POE (8 mole) oleylamine |
| *7 | sodium alkylsulfonate |
| *8 | potassium iso-cetyl phosphate |
| *9 | 4,4'-butylidene bis (t-butylcresol) (as anti-oxidant) |

TABLE 4

| | Example | | | | Comparison | | | |
|---|---|---|---|---|---|---|---|---|
| | 9 | 10 | 11 | 12 | 6 | 7 | 8 | 9 |
| E | 60 | | | 40 | | | | |
| H | | 60 | | | | | | |
| I | | | 60 | | | | | |
| A' | | | | 20 | | | 20 | |
| C' | | | | | 60 | | | |
| D' | | | | | | 60 | | 15 |
| E' | | | | | | | 40 | |
| F' | | | | | | | | 45 |
| *4 | 13 | 15 | 15 | 15 | 15 | 13 | 15 | 15 |
| *5 | 10 | 10 | 10 | 10 | 10 | 10 | 10 | 10 |
| *6 | 10 | 10 | 10 | 10 | 10 | 10 | 10 | 10 |
| *7 | 2 | 2 | 2 | 2 | 2 | 2 | 2 | 2 |
| *8 | 3 | 3 | 3 | 3 | 3 | 3 | 3 | 3 |
| *9 | 2 | | | | | 2 | | |
| Friction | A | A | A | A | C | E | E | D |

Note:
Numbers in units of wt %

TABLE 5

| Symbol | Compound |
|---|---|
| C | Same as in Table 1 |
| D | Same as in Table 1 |
| E' | Same as in Table 1 |
| F' | Same as in Table 3 |
| G' | polyoxyalkylene monobutylether (PO/EO = 50/50; MW = 2000, block) |
| H' | polyoxyalkylene glycol (PO/EO = 70/30; MW = 5500, random) |
| | Surfactants |
| *10 | POE (20 mole) condensate of hydrogenated castor oil |
| *11 | sodium lauryl sulfonate |
| *12 | potassium lauryl phosphate |

TABLE 6

| | Example | | Comparison | |
|---|---|---|---|---|
| | 13 | 14 | 10 | 11 |
| C | 20 | | | |
| D | | 20 | | |
| E' | | | 20 | |
| F' | | | | 20 |
| G' | 30 | 30 | 30 | 30 |
| H' | 34 | 34 | 34 | 34 |
| *10 | 10 | 10 | 10 | 10 |
| *11 | 5 | 5 | 5 | 5 |
| *12 | 1 | 1 | 1 | 1 |

Note:
Numbers in units of wt %

What is claimed is:

1. A finish composition for synthetic yarns, said composition comprising 10–80 wt % of a lubricant including a compound shown by Formula (1) given below and 10–60 wt % of a surfactant:

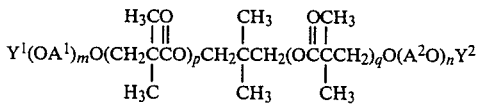

(1)

where $Y^1$ and $Y^2$ are monocarboxylic acid residues shown by Formula (2) or Formula (3) given below, at least one of $Y^1$ and $Y^2$ being monocarboxylic acid residue shown by Formula (2), $A^1$ and $A^2$ are alkylene groups with 2–4 carbon atoms, m and n are same or different, each being 0 or an integer in the range of 1–10, p and q are equal or different, each being 0 or an integer in the range of 1–4 such that (p+q) is an integer in the range of 1–4:

$$R^1S(CH_2)_rCO— \quad (2)$$

wherein $R^1$ is alkyl group or alkenyl group with 6–22 carbon atoms and r is an integer in the range of 1–3, and $$R^2CO— \quad (3)$$

where $R^2$ is alkyl or alkenyl group with 7–25 carbon atoms.

2. The composition of claim 1 wherein (p+q) is 2 or 3.

3. The composition of claim 2 wherein $Y^1$ and $Y^2$ are both a monocarboxylic acid residue shown by Formula (2).

4. The composition of claim 1 wherein (p+q) is 1 and (m+n) is an integer in the range of 2–10.

5. The composition of claim 4 wherein $Y^1$ and $Y^2$ are both a monocarboxylic acid residue shown by Formula (2).

6. The composition of claim 1 wherein said lubricant contains 50–95 wt % of said compound shown by Formula (1) and 5–50 wt % of triglyceride of aliphatic acid with 12–24 carbon atoms.

7. The composition of claim 2 wherein said lubricant contains 50–95 wt % of said compound shown by Formula (1) and 5–50 wt % of triglyceride of aliphatic acid with 12–24 carbon atoms.

8. The composition of claim 3 wherein said lubricant contains 50–95 wt % of a compound shown by Formula (1) and 5–50 wt % of triglyceride of aliphatic acid with 12–24 carbon atoms.

9. The composition of claim 4 wherein said lubricant contains 50–95 wt % of a compound shown by Formula (1) and 5–50 wt % of triglyceride of aliphatic acid with 12–24 carbon atoms.

10. The composition of claim 5 wherein said lubricant contains 50–95 wt % of a compound shown by Formula (1) and 5–50 wt % of triglyceride of aliphatic acid with 12–24 carbon atoms.

11. The composition of claim 1 wherein said lubricant contains 10–50 wt % of a compound shown by Formula (1) and 50–90 wt % of a polyether compound.

12. The composition of claim 2 wherein said lubricant contains 10–50 wt % of a compound shown by Formula (1) and 50–90 wt % of a polyether compound.

13. The composition of claim 3 wherein said lubricant contains 10–50 wt % of a compound shown by Formula (1) and 50–90 wt % of a polyether compound.

14. The composition of claim 4 wherein said lubricant contains 10–50 wt % of a compound shown by Formula (1) and 50–90 wt % of a polyether compound.

15. The composition of claim 5 wherein said lubricant contains 10–50 wt % of a compound shown by Formula (1) and 50–90 wt % of a polyether compound.

* * * * *